US006454530B1

(12) United States Patent
Lange

(10) Patent No.: US 6,454,530 B1
(45) Date of Patent: Sep. 24, 2002

(54) HIGH-TEMPERATURE FAN APPARATUS

(76) Inventor: Erik A. Lange, 1612 S. 76th St., Apartment 207, West Allis, WI (US) 53214

( * ) Notice: Subject to any disclaimer, the term of this patent is extended or adjusted under 35 U.S.C. 154(b) by 0 days.

(21) Appl. No.: 09/815,669

(22) Filed: Mar. 23, 2001

(51) Int. Cl.[7] ..... F04D 29/58
(52) U.S. Cl. ..... 415/177; 415/178
(58) Field of Search ..... 415/177, 178, 415/229, 111

(56) References Cited

U.S. PATENT DOCUMENTS

| | | | | | |
|---|---|---|---|---|---|
| 2,601,030 | A | * | 6/1952 | Klein et al. | 415/115 |
| 2,888,188 | A | * | 5/1959 | Hersh | 415/176 |
| 4,743,197 | A | * | 5/1988 | Bloom | 415/177 |
| 4,869,641 | A | * | 9/1989 | Hufgard | 384/465 |
| 5,322,007 | A | * | 6/1994 | Caridis et al. | 432/133 |

FOREIGN PATENT DOCUMENTS

| | | | | |
|---|---|---|---|---|
| JP | 62091700 A | * | 4/1987 | F04D/29/58 |
| JP | 62111199 A | * | 5/1987 | F04D/29/58 |
| JP | 62142900 A | * | 6/1987 | F04D/29/58 |

OTHER PUBLICATIONS

AFE Inc. High Temperature Fans and Blowers Catalogue. AFE Div. of The Alloy Engineering Co., 844 Thacker Street, Berea, Ohio 44017. 4 pages. Note p. 3. Undated, but the high temperature fans shown therin are believed to have been commercially available prior to Mar. 23, 2000.

The Alloy Engineering Co. Company Information Brochure. "2000 Corporate Spotlight Advertisement". The Alloy Engineering Co., 844 Thacker Street, Berea, Ohio 44017. 9 pages. Undated, but the high temperature fans shown therein are believed to have been commercially available prior to Mar. 23, 2000.

IGE Products. URL excepts of Industrial Gas Engineering Co. http://www.igefans.com 13 pages. Undated, but the high temperature fans shown therein are believed to have been commercially available prior to Mar. 23, 2000.

* cited by examiner

*Primary Examiner*—F. Daniel Lopez
*Assistant Examiner*—Richard Edgar
(74) *Attorney, Agent, or Firm*—Jansson, Shupe & Munger, Ltd.

(57) ABSTRACT

This invention comprises high temperature fan apparatus for use in displacing high-temperature gases and atmospheres, such as the atmosphere within a high-temperature furnace. The fan apparatus is configured to limit heat transfer through the fan apparatus without the need for separate fan-cooling apparatus thereby preventing bearing damage and generally increasing the fan's operational life. The preferred fan includes a frame supporting the fan. One or more bearings rotatably support a fan shaft. A fan element is supported by the fan shaft, The fan element may be within the furnace interior. Heat transfer through the fan and fan shaft is limited by at least one bore positioned in at least a portion of the fan shaft. Heat transfer through the fan is further limited by thermal barrier material secured with respect to the frame. Oversized bearing structure may additionally be provided to further limit heat transfer from the fan shaft to the bearings.

31 Claims, 8 Drawing Sheets

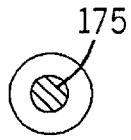
FIG. 4D
FIG. 4C
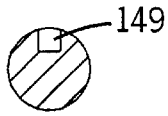
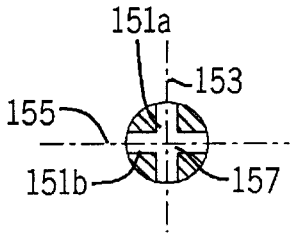
FIG. 4B
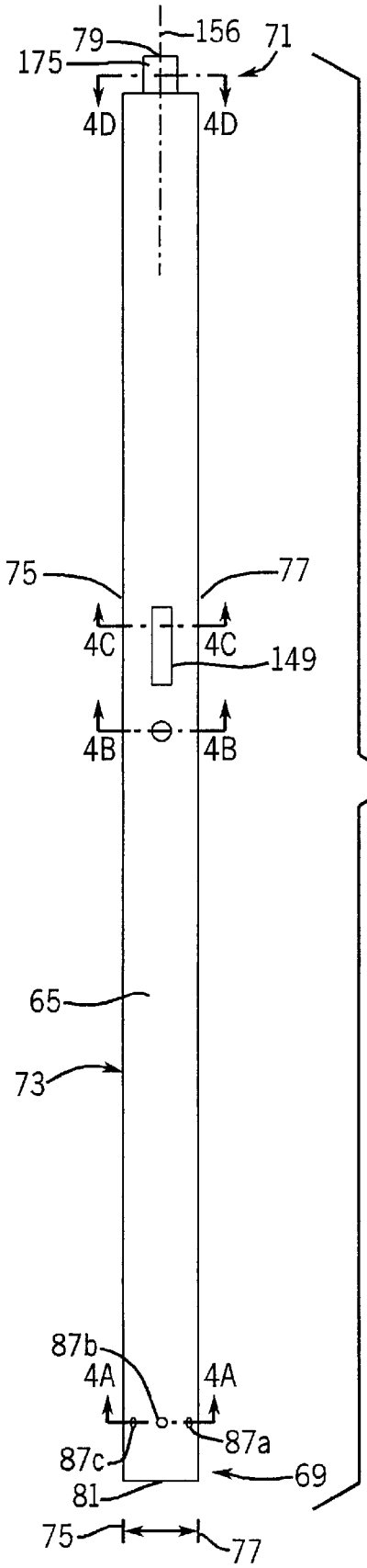
FIG. 4
FIG. 4A
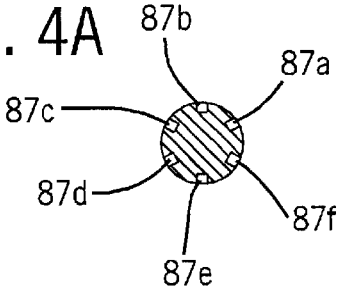

HIGH-TEMPERATURE FAN APPARATUS

FIELD OF THE INVENTION

This invention is related to displacement apparatus for distributing high temperature gases and atmospheres in high-temperature environments and, more specifically, to high-temperature-resistant fan apparatus.

BACKGROUND OF THE INVENTION

High temperature furnaces and ovens are commonly employed in industry for use in heat treating metal parts and products. Such furnaces are commercially available from sources such as Ipsen, Inc. of Rockford, Ill., Oven Systems, Inc. of Milwaukee, Wis. and Flinn & Dreffein Engineering Co. of Northbrook, Ill. These high-temperature furnaces typically consist of a rectangular furnace body having a top wall, side walls and a bottom wall. The furnace walls define a furnace interior or chamber in which the parts or other articles to be heated are placed. The furnace walls typically have a thickness (i.e., a dimension between the wall outer and inner surfaces) on the order of about 8 to 10 inches. One or more doors are provided in the furnace walls for purposes of moving the parts and products into and out of the furnace interior.

The furnace interior is typically heated by use of gas-fired burners positioned along the furnace top and/or bottom walls. Heated air or other gas is directed from the burners into one or more heating elements positioned through the furnace top and/or bottom walls and within the furnace interior. Heat transfer from the elements to the furnace interior heats the furnace interior to the desired temperature, typically (but not exclusively) in the range of about 1000 to 1850° F. Gas burners for use in heating high temperature furnaces may include, for example, single ended recuperative burners available from Eclipse Combustion, Inc. of Rockford, Ill.

Heat treating of metal parts and products within the furnace is an exacting and demanding process. In order to uniformly heat treat parts within the furnace the operator must carefully control conditions within the furnace. To this end, it is essential that a uniform temperature be maintained within the furnace and that thermal gradients be avoided. Gases such as nitrogen and hydrogen are frequently introduced into the furnace interior in order to impart particular properties to the parts and metal products. Such gases, and the atmosphere generally, must be uniformly distributed within the furnace interior. The furnace and its components must be designed to withstand the elevated furnace temperatures as well as the corrosive environment created by the gases and materials within the furnace.

Fans, such as "plug fans," have been developed in an effort to provide a uniform temperature within the furnace and to evenly distribute the furnace atmosphere. A plug fan typically consists of a frame which is inserted, or plugged, into an opening in the furnace top wall. Fan blades mounted on a fan shaft extend from the frame into the furnace interior. The fan shaft is rotatably mounted on one or more bearings located within the frame or outside of the furnace. A motor coupled to the fan shaft rotates the shaft so as to rotate the fan blades within the furnace interior. Rotation of the fan blades within the furnace interior displaces the furnace atmosphere and uniformly distributes the temperature and gases within the furnace interior. Commercial sources of plug fans include Alloy Engineering Co. of Berea, Ohio and Industrial Gas Engineering Co., Inc. of Westmont, Ill.

A major shortcoming of prior art plug fans used in connection with high temperature furnaces is that the harsh operating environment and high temperatures of such furnaces rapidly damage the fan thereby shortening the fan's useful life. Thermodynamic heat transfer in the form of conduction, radiation and convection all act to damage the fan. For example, heat from within the furnace interior is conducted through the fan and fan shaft into the bearings supporting the fan shaft. Radiant and convection heat can be transferred along the fan shaft or through the fan frame to the bearings, fan motor and other fan components. Such heat transfer causes the bearings and other fan components to fail requiring replacement or extensive repair of the fan. Standard bearings are particularly susceptible to failure at temperatures of approximately 300° F. at which point typical lubricants fail resulting in bearing failure and damage to the fan. Direct costs are incurred to replace or repair the fan and indirect costs are incurred based on the operator's inability to operate the furnace.

In an effort to limit heat and furnace-related fan damage and extend the useful life of the fan, certain fans have been equipped with separate, active cooling systems. Such active cooling systems are provided to remove heat from the fan shaft and fan frame thereby limiting heat transfer into, and failure of, the bearings and other components. For example, certain plug fans are provided with a water-cooled frame. Chilled water is piped under pressure through the frame in order to remove heat from the fan. Other plug fans utilize compressed air cooling systems in which heat is removed from the fan by passing a stream of compressed air over the fan.

Such active cooling apparatus disadvantageously adds unnecessary cost to the fan both in terms of the cooling apparatus and in terms of the cost to operate such apparatus. The cooling apparatus may be subject to failure, for example, if impurities within the coolant supply line limit the flow of coolant to the bearings. And, inclusion of such active cooling apparatus with the fan adds a further maintenance item with respect to operation of the furnace.

Other applications may have high-temperature environments which require apparatus to displace gases within said environments. The foregoing problems with respect to the fan apparatus used in furnaces can also affect these other applications. The apparatus selected for use in displacing high temperature gases must be resistant to damage from the elevated temperatures yet at the same time be durable and economical to operate.

An improved fan for use in high-temperature environments, such as those found in heat treating furnaces, which would facilitate displacement of the atmosphere within such environments resulting in uniform temperatures and gas distribution yet would not require any separate active cooling apparatus would represent an important advance in the art.

OBJECTS OF THE INVENTION

It is an object of this invention to provide improved high-temperature fan apparatus overcoming some of the problems and shortcomings of the prior art.

An important object of this invention is to provide improved high-temperature fan apparatus which are high-temperature resistant.

It is also an object of the invention to provide improved high-temperature fan apparatus capable of operation in high-temperature environments without separate active fan-cooling apparatus.

A further object of the invention is to provide improved high-temperature fan apparatus which limit heat transfer through the fan thereby extending the useful life of the fan.

Yet another object of the invention is to provide improved high-temperature fan apparatus which are resistant to corrosive conditions found in high-temperature environments.

Another object is to provide improved high-temperature fan apparatus which are economical to manufacture and maintain.

Still another object of the invention is to provide improved high-temperature fan apparatus which may be easily adapted for use in many different high-temperature applications.

How these and other objects are accomplished will be apparent from the following descriptions and from the drawings.

SUMMARY OF THE INVENTION

Briefly described, the invention is fan apparatus for circulating high temperature gas comprising the atmosphere within a chamber, most typically the chamber comprising a furnace interior. The invention is described herein with respect to an exemplary furnace but could be used in other high temperature applications. The high-temperature fan apparatus is specially designed to limit heat transfer through the fan apparatus, particularly to the bearings and other heat-sensitive components. The novel fan structure advantageously extends the useful life of the fan and yet avoids any need for separate, active fan-cooling apparatus.

In general, preferred forms of the fan include a frame, a fan shaft rotatably secured with respect to the frame, a fan element secured along the shaft and thermal barrier material secured with respect to the frame.

The frame is preferably provided with support surfaces configured to support the fan apparatus. The frame may be configured to support the fan at an opening in a wall, such as the wall of a furnace. Alternatively, the frame may be configured to support the fan with respect to other structure closely associated with the furnace. A highly preferred form of the frame is configured to be positioned at least partially in the wall opening and the frame and thermal barrier material are conformably shaped to said opening. It is most highly preferred that the frame includes a substantially flat back plate and at least one sidewall secured to and projecting outwardly from the back plate. Preferably, the at least one sidewall and back plate form a cavity in which the thermal barrier material is secured.

The fan shaft is supported for rotation, preferably by at least one bearing member at a position outside the chamber or interior of the furnace. The fan shaft has first and second ends and a shaft outer surface therebetween. In highly preferred embodiments, the shaft is sized to support the fan element through the wall opening and within the chamber. It is highly preferred that the shaft include at least one bore positioned trans-axially through at least a portion of the shaft at a position between the chamber and the at least one bearing member. The at least one bore is provided to limit heat transfer across the bore and toward the shaft second end. It is highly preferred that the such bore structure extends entirely through the shaft. Most preferably, the shaft includes first and second co-planar bores and each bore is positioned along an axis transverse to the other and normal to the shaft.

Preferred forms of the high-temperature fan apparatus further include a bearing mount secured with respect to the frame. First and second axially-aligned bearings are secured to the bearing mount. The fan shaft of this embodiment is journaled in the bearings.

It is preferred that at least the first bearing include structure designed to limit heat transfer from the fan shaft to the bearing. The preferred bearing structure preferably comprises an inner race, an outer race and ball bearings positioned therebetween. The inner race has an inner surface facing the fan shaft and an inside diameter. A pin projects radially inwardly from the inner race. The fan shaft of this embodiment includes an opening keyed to the pin for co-rotation of the shaft and inner race. In addition, the shaft is sized so that the shaft has a diameter which is less than the inner race inside diameter. As a result of this structure, the shaft outside surface and inner race inner surface contact along less than all of the respective surfaces when the shaft is journaled in the first bearing. Such structure limits heat transfer into the first bearing.

The most highly preferred high-temperature fan apparatus includes a fan element which includes plural fan blades secured at one end along the fan shaft and extending radially outwardly from said shaft. Other types of fan elements may be used with the invention.

The thermal barrier material includes an opening through which the shaft is rotatably positioned. Thermal barrier material with shaft-contact surfaces is provided along the opening in direct contact with the shaft to limit heat transfer through the frame and along the shaft outer surface. Preferably, the thermal barrier material comprises, at least in part, plural insulation elements. Each element has side walls, end walls, an inner edge surface positioned to face the furnace interior and an opposed outer edge surface. The preferred elements are arranged one after the other so that adjacent sidewalls abut. It is highly preferred that the thermal barrier material further includes heat-resistant barrier material applied along the insulation element inner edge surfaces.

The shaft may be rotated by a motor coupled in torque-transmitting relationship to the shaft. The motor is preferably coupled to the shaft at a position between the bore and shaft second end. The motor is preferably secured with respect to the frame at a motor mount. The motor is coupled to the shaft by horsepower-transmitting members. Preferably, the horsepower-transmitting members are a first pulley secured for co-rotation with a motor shaft, a second pulley secured for co-rotation with the fan shaft and a belt linking the pulleys.

BRIEF DESCRIPTION OF THE DRAWINGS

The drawings illustrate preferred embodiments which include the above-noted characteristics and features of the invention. The invention will be readily understood from the descriptions and drawings. In the drawings:

FIG. 4 is a plan view of an exemplary fan shaft.

FIG. 4A is a cross section of the fan shaft of FIG. 4 taken along section line 4A—4A.

FIG. 4B is a cross section of the fan shaft of FIG. 4 taken along section line 4B—4B.

FIG. 4C is a cross section of the fan shaft of FIG. 4 taken along section line 4C—4C.

FIG. 4D is a cross section of the fan shaft of FIG. 4 taken along section line 4D—4D.

DETAILED DESCRIPTIONS OF THE PREFERRED EMBODIMENTS

Preferred embodiments of the inventive high-temperature fan apparatus 10 will now be described with respect to FIGS. 1–9. Fan 10 will be described for use in an exemplary heat treating furnace 12 although fan 10 may have application in other high-temperature settings. As is known, heat treating furnaces are used to strengthen and impart beneficial properties to metal parts and products. The environments within the chamber or interior of such furnaces are typically in the range of about 1000 to 1850° F. but can exceed temperatures of about 2200° F. Such environments may also include corrosive gases. The fan structure disclosed herein is adapted for use in such harsh environments and includes structure which prevents damage to the bearings and other fan components caused by exposure to such conditions.

Figure 1:
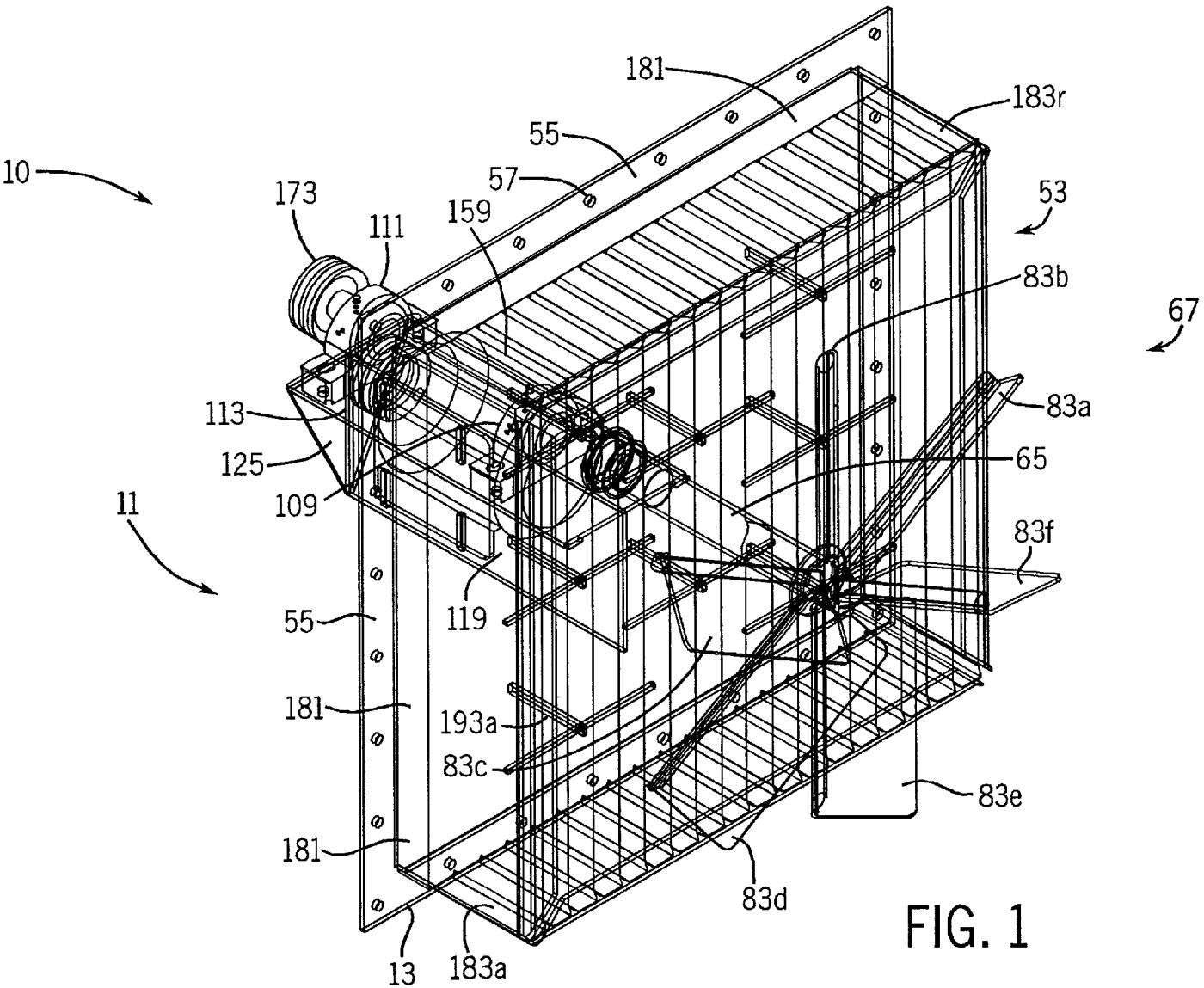
FIG. 1 is a perspective view (shown as a wire-frame representation) of an exemplary fan according to the invention.
Figure 2:
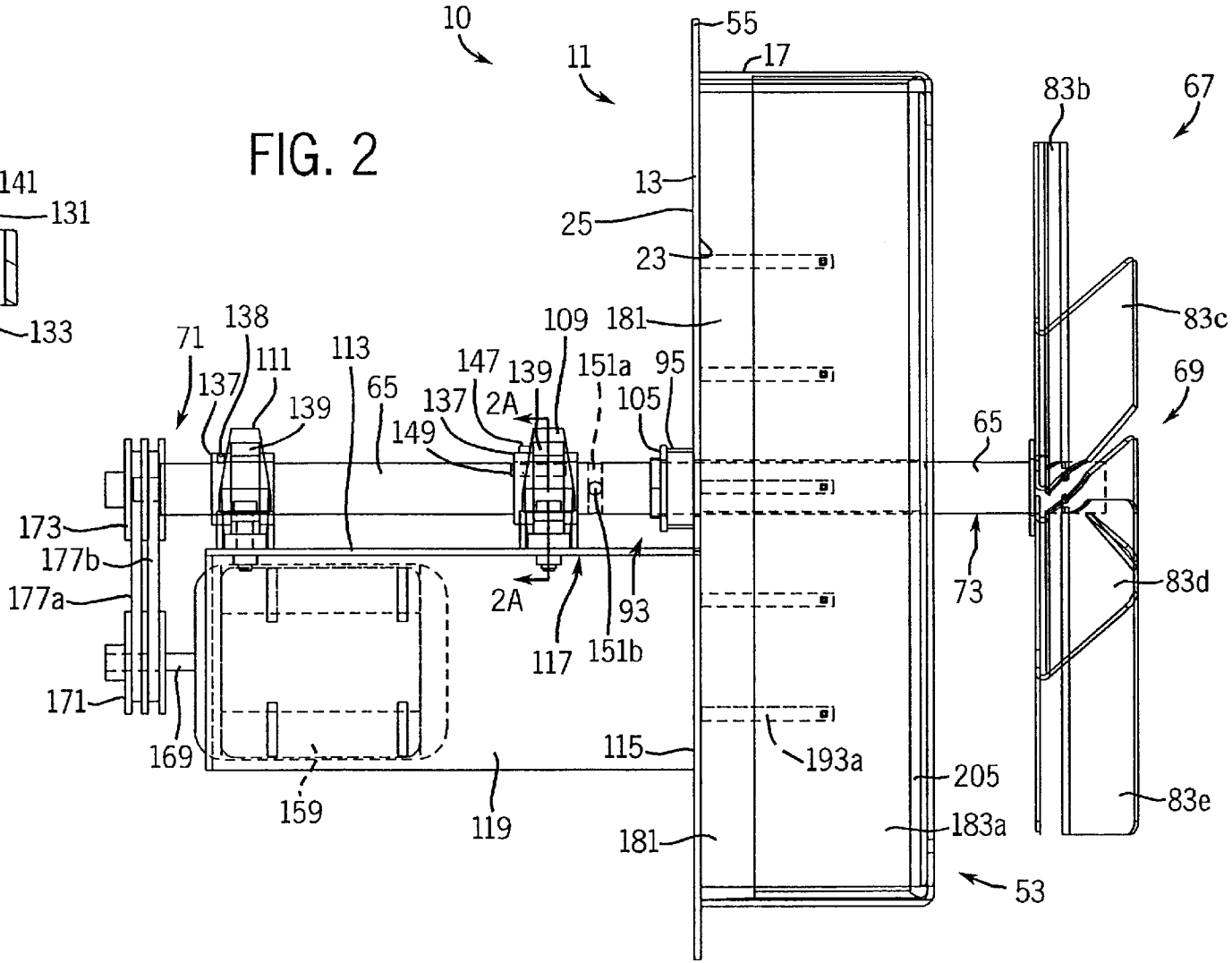
FIG. 2 is a side elevation of the exemplary plug fan of FIG. 1 also shown as a wire frame representation.
Figure 3:
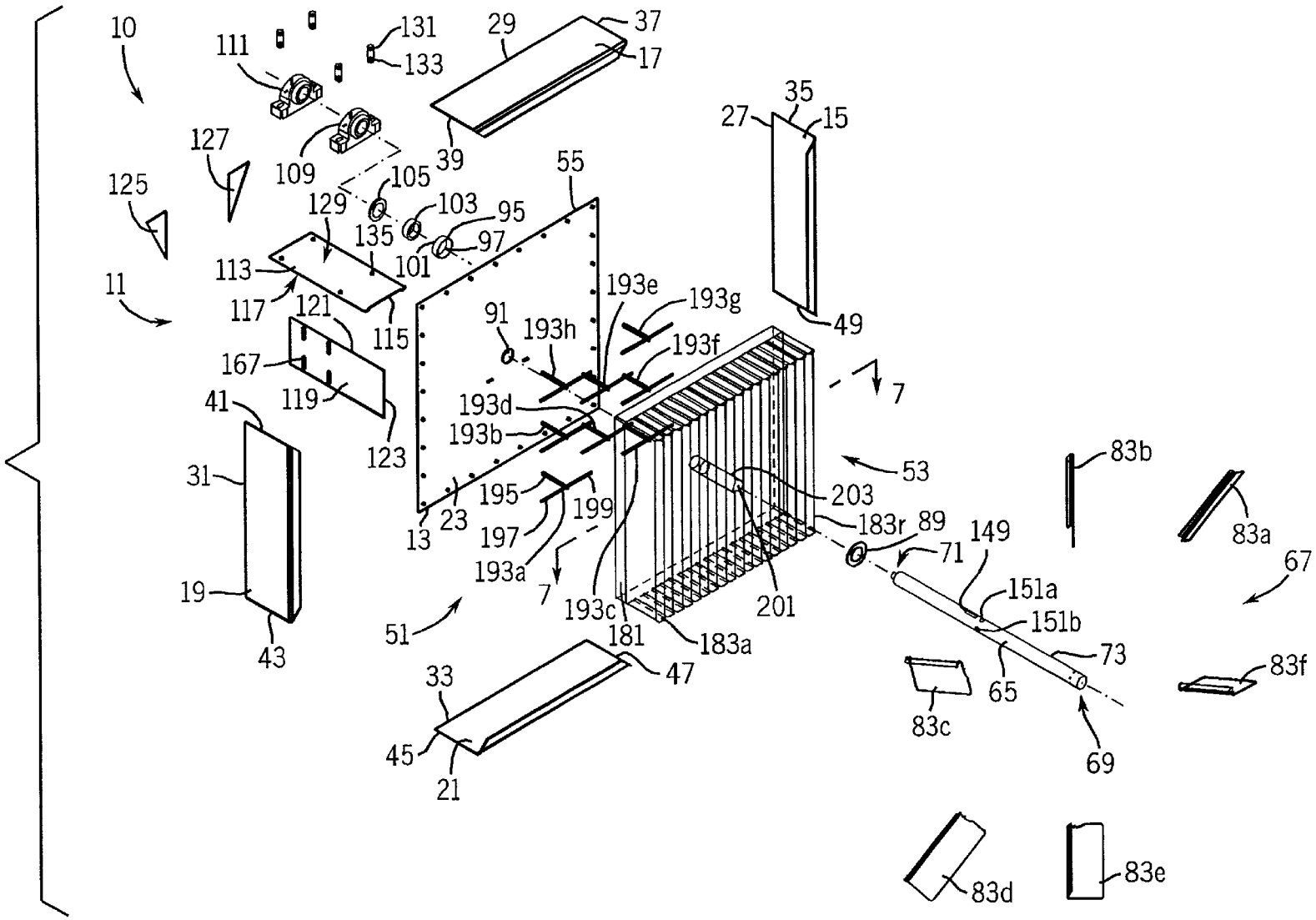
FIG. 3 is an exploded diagram of the exemplary plug fan of FIG. 1 also shown as a wire frame representation.

Referring first to FIGS. 1–3, those figures provide wire frame representations of an exemplary fan 10 according to the invention. Fan 10 includes a fan frame 11. Preferred frame 11 includes back plate 13, side plates 15–21 and the related structure described herein. Back plate 13 is a substantially flat member having an inner surface 23 and an outer surface 25. Side plates 15–21 have a respective inner edge 27–33 secured to back plate inner surface 23, preferably by welding. Back plate 13 and side plates 15–21 are preferably made of carbon steel plate.

As shown in FIG. 3, side plates 15–21 include end edges 35–49 and side plates 15–21 are positioned along back plate inner surface so that adjacent end edges 35–49 abut. The adjacent end edges (for example, edges 35 and 37) are secured one to the other, preferably by welding. Back plate 13 and side plates 15–21 form a cavity 51 for receiving and securing thermal barrier material 53 with respect to frame 11 as discussed in greater detail below.

Figure 8:
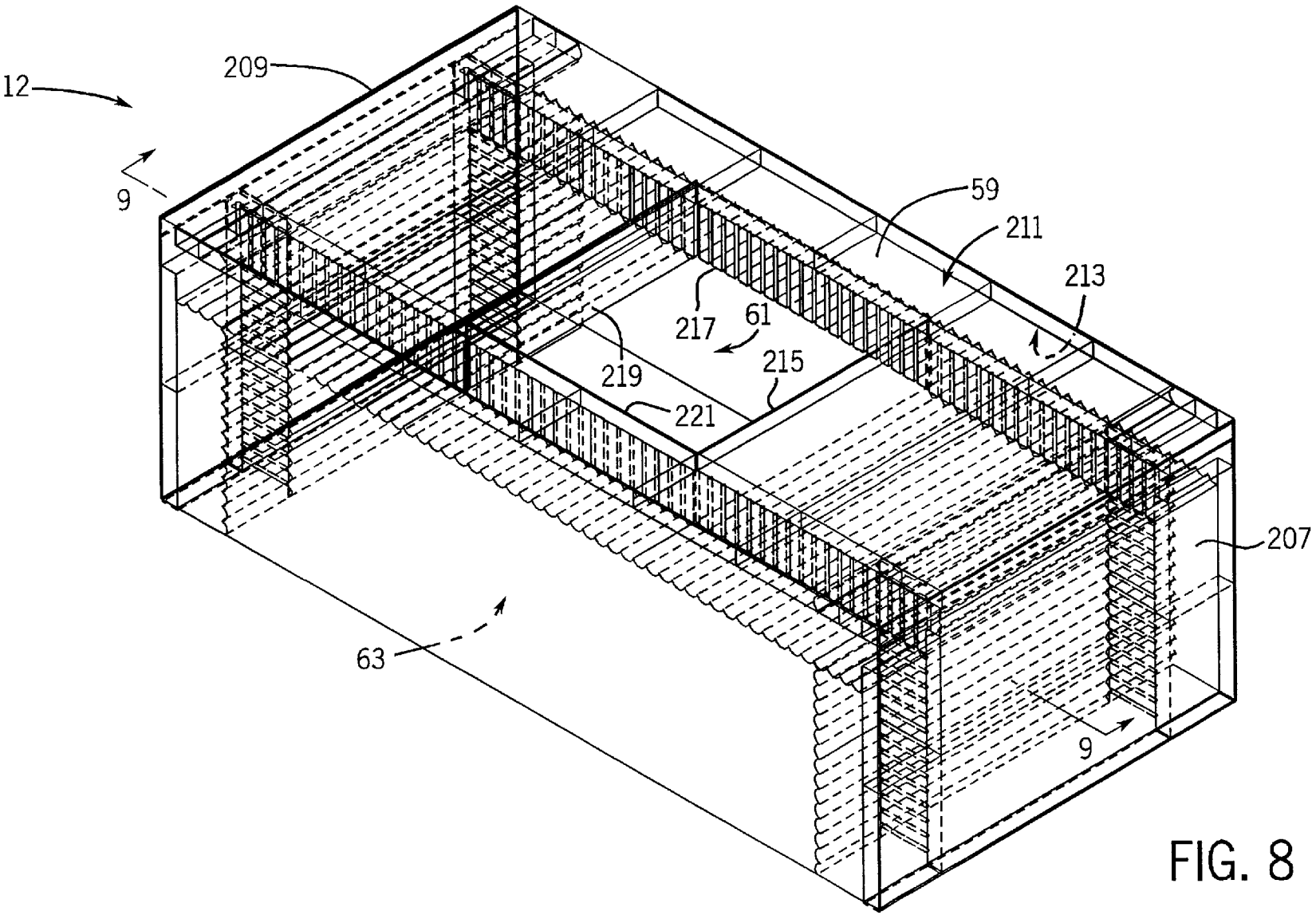
FIG. 8 is perspective view of a partial furnace top wall portion also shown as a wire frame representation.
Figure 9:
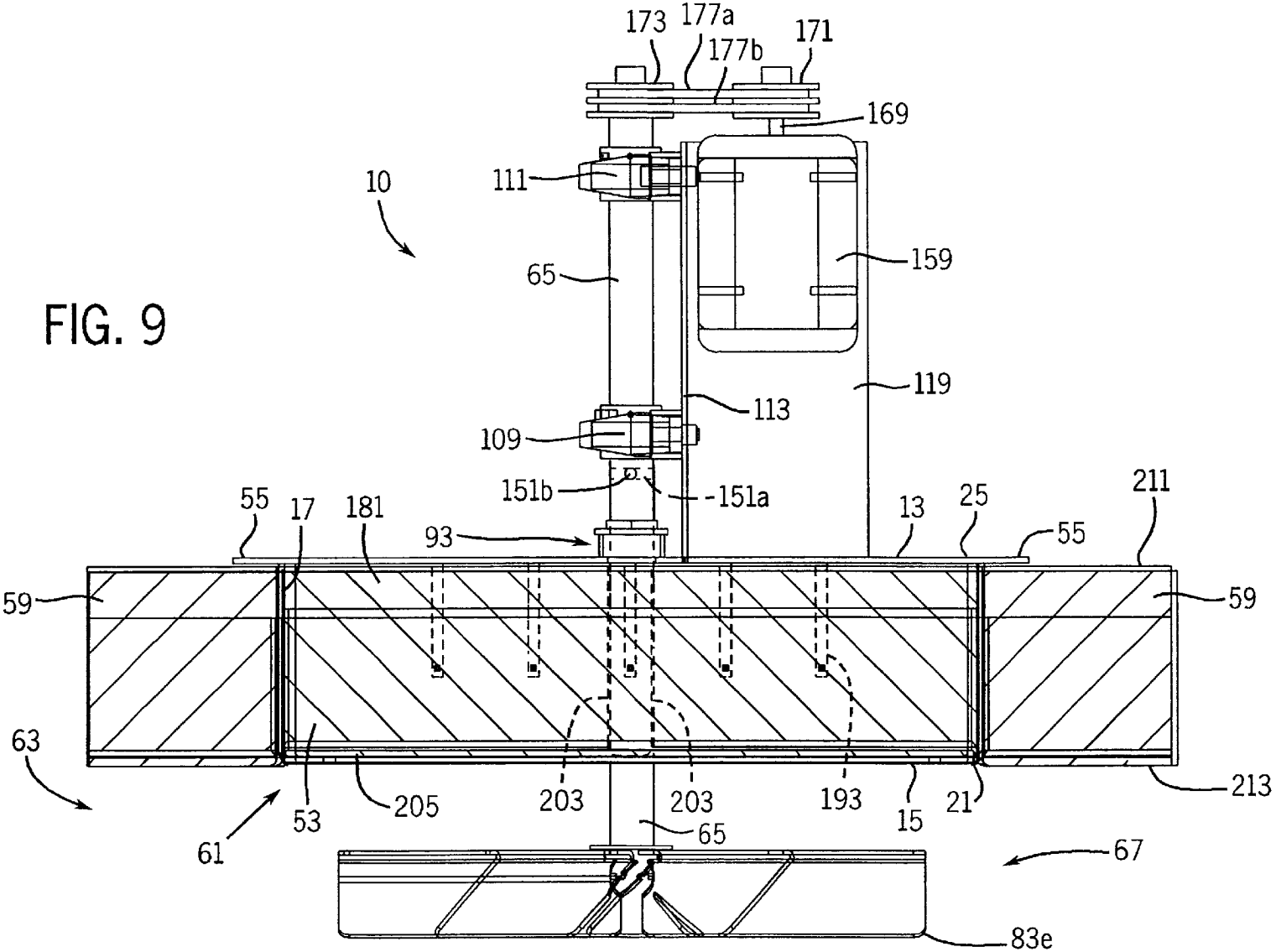
FIG. 9 is partial cross section of the top wall of FIG. 8 taken along section line 9—9 and showing an exemplary fan positioned in such wall.

Side plates 15–21 are preferably secured with respect to back plate 13 so as to create a mounting flange 55 around the periphery of back plate 13. Plural openings, such as opening 57, are provided along flange 55 for receiving fasteners (such as screws). The fasteners are used to secure flange 55 with respect to a wall partially defining a furnace chamber or interior 63, such as top wall 59, and wall opening 61. (FIGS. 8 and 9). In the example shown, back plate 13, side plates 15–21 and flange 55 may be sized and arranged as required to position fan 10 tightly in furnace wall opening 59 so as to prevent heat and gas transfer out of furnace interior 63.

Referring now to FIGS. 1–4D, 8 and 9, fan shaft 65 is provided to support fan element 67 through a furnace wall opening (such as opening 61) and within furnace interior 63. Fan shaft 65 includes first and second ends 69, 71 and a shaft outer surface 73 therebetween. The material used in the manufacture of fan shaft 65 will vary depending on the furnace temperatures of the particular application. Number 330 stainless steel is one material satisfactory for use in manufacture of fan shaft 65. For higher temperature applications, for example in the range of 1200 to 1800° F., nickel alloys may be used. Suitable nickel alloys include #304, #310, #600 or #333 nickel alloys. The preferred fan shaft diameter (between reference numbers 75 and 77) is approximately two inches, although other shaft diameter dimensions may be appropriate given the particular application. In the example shown, fan shaft 65 has an axis 156 with a sufficient axial length (between reference numbers 79 and 81) so that fan element 67 may be positioned within furnace interior 63 and in contact with the gases comprising the atmosphere within the furnace 12.

Fan element 67 is provided along shaft first end 69. Fan element 67 preferably comprises an axial fan including blades 83*a–f*. Number 330 stainless steel is a preferred material for use in the manufacture of blades 83*a–f*. Other materials, such as the #304, #310, #600 or #333 nickel alloys described with respect to the fan shaft 65 may be used. As shown best in FIGS. 4A and 5, each blade 83*a–f* is secured with respect to fan shaft first end 69 by means of blade nub 85*a* secured within a corresponding bore 87*a–f*. Each blade is preferably welded to fan shaft 65. FIGS. 1–3 and 5 show gusset 89 which may be secured along fan shaft 65 and to blades 83*a–f*in order to further support such fan blades.

The surfaces of fan element 67 and those portions of fan shaft 65 within furnace interior may be coated with a coating (not shown) such as Cetek M-720 coating available from Cetek of Transfer, Pennsylvania. Such a coating has low gas permeability and prevents chemical degradation of the base material used to manufacture the fan element and fan shaft. Cetek M-720 coating is particularly useful in preventing carburization of nickel-based alloys which can occur in high-temperature environments. The Cetek coating is applied as a liquid in a sufficient amount to have a thickness, when dried, of approximately 0.001 to 0.004 inches.

Fan element 67 is not limited to an axial fan having six blades as shown in FIGS. 1–5 as any number of appropriate blades could be used. Moreover, other types of fan elements, such as a centrifugal fan, could be used consistent with the scope of the invention.

Referring now to FIGS. 1–3, fan shaft 65 is positioned through annular opening 91 provided in back plate 13. Opening 91 has a diameter which is slightly greater than fan shaft diameter (between reference numbers 75 and 77) providing a partial barrier against heat transfer through fan 10 along fan shaft 65.

As is well-shown in FIGS. 2 and 3, compression sell 93 is provided along back plate outer surface 29 and along fan shaft outer surface 73 to further limit convective and radiant heat transfer through fan 10 along fan shaft 65. Compression seal 93 comprises annular pipe half coupling 95 welded at one end 97 to back plate outer surface 29 and having threads (not shown) on an opposite end 101. High temperature-resistant packing material 103 is positioned within pipe half coupling 95. Graphite teflon rope is a preferred material for use as packing material 103. Such rope has a temperature rating of about 550° F. Packing material 103 is positioned to directly abut the circumference of fan shaft outer surface 73 positioned through compression seal 93. A packing nut 105 having mating threads 107 is secured onto corresponding threads 99 of pipe half coupling 95 thereby securing packing material 103 within compression seal 93. Other types of seals known to those of skill in the art may be utilized.

Referring again to the preferred embodiment of FIGS. 1–3, fan shaft 65 is journaled in, and rotatably supported by, pillow block bearings 109, 111. Other types of bearings and rotatable supports known to those of skill in the art may be utilized.

Bearing mount 113 is provided as a support surface for bearings 109, 111. Bearing mount 113 is secured at end 115 to back plate outer surface 29, preferably by welding. Bearing mount 113 is further supported along mount bottom side 117 by motor mount 119. Motor mount upper edge surface 121 is secured to bearing mount bottom side 117 and motor mount inner edge surface 123 is secured to back plate outer surface 29, all preferably by welding. Gussets 125, 127 are provided to support bearing mount 113 with respect to motor mount 117. As shown in FIG. 1, bearing mount 113 and motor mount 117 preferably have a "T-shaped" configuration when viewed in an end elevation. Carbon steel plate is a suitable material for use in manufacture of bearing and motor mounts 113, 117 and gussets 125, 127.

Bearings 109, 111 are secured to top side 129 of bearing mount 113 by suitable fasteners, such as bolt and nut 131, 133 inserted through opening 135 provided in bearing mount 113. Bearings 109, 111 are mounted along bearing mount 113 such that they are axially aligned. Fan shaft 65 is journaled in bearings 109, 111. Each bearing includes annular inner and outer races 137, 139 and ball bearings (not shown) positioned between the inner and outer races 137, 139. The inner race 137 for bearings 109, 111 may be secured for co-rotation with shaft 65 by means of a set screw, such as set screw 138 shown with respect to bearing 111 in FIG. 2.

Figure 2A:
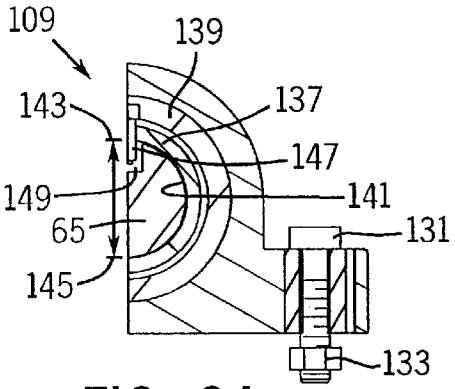
FIG. 2A is a partial cross section of the bearing of FIG. 2 taken along section line 2A—2A.

Referring to FIGS. 2 and 2A, bearing 109 may be specially configured to limit heat transfer from fan shaft 65 and into bearing 109. Specifically, bearing 109 inner race 137 has an inner surface 141 facing fan shaft outer surface 75. Inner race 137 has an inside diameter (between reference numbers 143 and 145). Inner race 137 is configured such that the inside diameter is slightly greater than the fan shaft diameter (between reference numbers 75 and 77). Pin 147 is tapped into and projects radially inwardly from inner race 137.

As shown in FIGS. 2–4 and 4C, fan shaft 65 includes slot 149 provided to mate with pin 147 when fan shaft 65 is journaled in bearing 109 causing inner race 137 to co-rotate with fan shaft 65 . Advantageously, this arrangement positions shaft outer surface 75 along less than the entire circumference of inner race inner surface 141. As a result, there is less than complete surface-to-surface contact between fan shaft 65 and bearing 109 thereby limiting potential heat transfer from fan shaft 65 into bearing 109 prolonging the useful life of bearing 109. The slightly oversized inner race 137 and slot 149 and pin 147 further permits thermal expansion of fan shaft 65 without placing undue stress on bearing 109, again prolonging the useful life of bearing 109. Bearing 111 and shaft 65 portions in contact with bearing 111 may have the same structure as described with respect to bearing 109 and shaft 65.

Fan shaft 65 includes structure provided to limit heat transfer through fan shaft 65 and into bearings 109, 111. Specifically, and as shown in FIGS. 2, 3 and 4, fan shaft 65 includes bores 151*a*, 151*b* positioned trans-axially through at least a portion of fan shaft 65. Bores 151*a*, 151*b* act as a barrier limiting heat flow through shaft 63 as discussed below.

As shown in FIG. 2, bores 151*a*, 151*b* are most preferentially located along fan shaft 65 at a position between back plate 13 and bearing 109. However, bores 151*a*, 151*b* could be located along shaft 63 at a position between the fan shaft first end and bearing 109 and outside of furnace interior 63.

As shown in FIGS. 2, 3, 4 and 4B, two bores 151*a*, 151*b* are preferably provided in fan shaft 65 . Each bore 151*a*, 151*b* is preferentially positioned trans-axially entirely through fan shaft 65. As shown best in FIGS. 2 and 4B, bores 151*a*, 151*b* are most preferably co-planer and each is positioned along an axis 153, 155 transverse to the other and normal to fan shaft axis 156. Each bore 151*a*, 1551*b* is preferably provided by cross-drilling fan shaft 65. This arrangement advantageously removes the center or core 157 of fan shaft 65 which is a highly heat conductive portion of fan shaft 65. Further, bores 151*a*, 151*b* allow air to circulate through fan shaft 65 as the shaft rotates removing heat from fan shaft 65.

While the cross-drilled bore configuration shown in FIG. 4B is most highly preferred, other bore arrangements and configurations are suitable within the scope of the invention. For example, one bore, or three or more bores, could be utilized depending on the material selected for use in manufacture of fan shaft 65 and the diameter of such shaft.

Each bore, such as bores 151*a*, 151*b*, need not be positioned entirely through fan shaft 65 . Further, each bore need not be positioned normal to the fan shaft axis and could be oriented along axes, other than those normal to the shaft axis. It should be further noted that use of the term "bore" is not intended to be limited to an opening made by a rotary tool. A bore is meant to be an opening (i.e., void volume, cavity) provided in the fan shaft 65 by any suitable means, such as by forming such opening in the shaft during manufacture. Moreover, the bore, such as bores 151*a*, 151*b*, could be filled with a material which is not heat conductive or has limited heat conductivity.

Referring next to FIGS. 1–3 and 9, fan shaft 65 is rotated by a motor 159 which is preferably an electric motor of between about 2–5 horsepower. Motor 159 is mounted to motor mount 119 by fasteners, such as bolts and nuts (not shown) positioned through mounting openings (not shown) in motor 159 and corresponding openings, such as opening 167, provided in motor mount 119. Motor 159 includes a drive shaft 169 and a pulley 171 secured thereto. Pulley 173 is secured to a nub 175 (FIG. 4D) along fan shaft second end 71. Belts 177*a* and 177*b* are provided to couple motor 159 to fan shaft 65 in a torque-transmitting relationship. Motor 159 may be coupled to fan shaft 65 in other manners for example, in a direct drive relationship or through a sprocket and chain linkage.

Fan frame 11 includes further structure provided to limit heat transfer through fan 10. Specifically, thermal barrier material 53 is secured within cavity 51 formed by back plate 13 and side plates 17–23. As described in more detail below, the thermal barrier material 53 is provided both as a barrier to heat transfer from the furnace interior to the fan 10 and as a heat sink which removes heat from the fan shaft 65.

Figure 7:
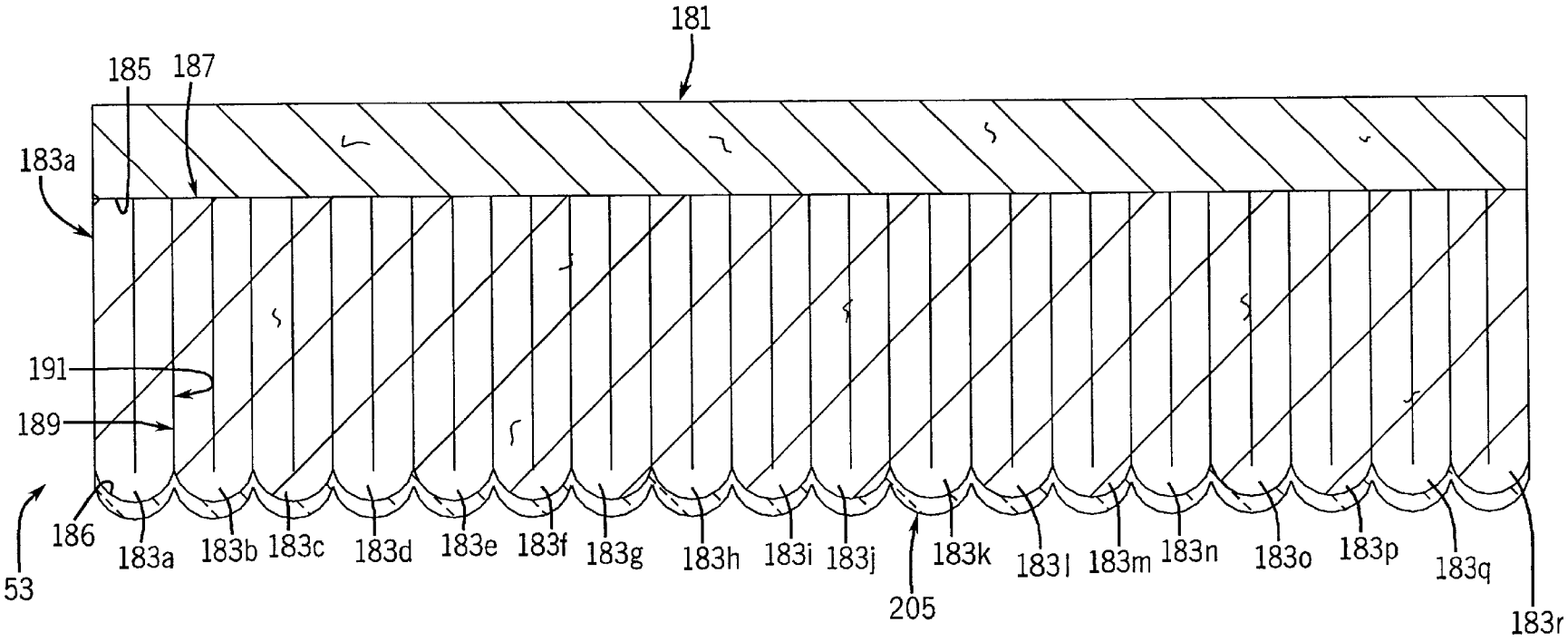
FIG. 7 is a cross section (shown as a schematic illustration) of the thermal barrier material taken along section line 7—7 of FIG. 3.

The preferred thermal barrier material 53 comprises an arrangement of thermal insulation material which is unique with respect to fans for use in high-temperature applications. As shown in FIGS. 1, 2 and 7, the thermal barrier material 53 comprises at least one insulation element 181 positioned along back plate inner surface 27 and plural insulation elements 183*a*–*r*, each stack-bonded one to the other and each having an edge 185 positioned against element 181 surface 187 and opposite edge 186. Each element 183*a*–*r* may be folded back against itself as shown in FIG. 7. The number of elements will be selected based on the configuration of the particular fan. The stack bonded elements, such as elements 183*a* and 183*b*, each have sidewalls, such as sidewalls 189, 191, and adjacent sidewalls are positioned to abut one another. Stack bonding refers to compression of insulation elements 183*a*–*r* by a factor of approximately 10–20%. After compression of elements 183*a–r*, those elements and element 181 are held in place by suitable apparatus, such as anchors 193*a–h*. This unique arrangement of perpendicularly-oriented insulation elements is a particularly efficient and preferred arrangement of insulation elements 181 and 183*a–r* because the arrangement prevents potential heat and gas loss from the furnace and through seams and openings between elements 183*a–r*. The thickness of the stack bonded element array 183*a–r* and the element 181 (i.e., from back plate inner surface 27 to edge surfaces 185) will vary depending on the particular furnace wall structure for which the fan 10 is intended; a thickness of about 8–10 inches is preferred.

Each anchor, such as anchor 193*a*, has one end 195 inserted through element 181 and secured to back plate inner surface 29 by, for example, welding. Anchor tines 197, 199 are inserted through each element, such as element 183*a*. Anchors 193*a–h* and side plates 17–23 hold the insulation elements in place in a compressed manner.

A preferred material for use in manufacture of the insulation elements, for example elements 181 and 183*a–r*, is CER-WOOL® brand ceramic fiber blanket available from Premier, Inc. of King of Prussia, Pa. One suitable material is Cer-Wool Premier High Purity, eight pound density spun fiber having a thickness of about 1 to 2 inches. High purity means that the material will not react with a hydrogen-gas-containing atmosphere. Thermal barrier material 53 is effective at limiting heat transfer through fan 10 so that the temperature at back plate outer surface 25 and compression seal 93 is less than about 500° F.

Fan shaft hole 201 is provided through the thermal barrier material 53. The hole may be cut through the CER-WOOL® elements if that material is used. Hole 201 is undersized to fan shaft 65 so that thermal barrier material 53 has surfaces 203 in direct contact with fan shaft outer surface 73. The close contact between surfaces 203 and shaft outer surface 73 limits heat transfer along fan shaft 65 to back plate 13 and compression seal 93. The preferred CER-WOOL® material has excellent wear resistance properties and can remain in direct contact with fan shaft outer surface 73 irrespective of rotation of fan shaft 65.

As shown in FIGS. 2 and 7, thermal barrier material 53 may include a further barrier layer 205 applied along inner edge surfaces, such as edge surface 186, of the insulation elements 183*a–r*, and positioned to face the furnace interior 63. A material suitable for use as barrier layer 205 is Top Coat M brand coating available from Unifrax Corporation of Niagra Falls, N.Y. Top Coat M is mixed in water and is sprayed onto the inner edge surfaces of the insulation elements once the insulation elements have been positioned within cavity 51. The material comprising layer 205 is applied in a sufficient amount to have a thickness, when dried, of approximately 0.035 to 0.063 inches. Top Coat M is a desirable material for use as barrier layer 205 because such material resists atmospheric wear and degradation caused by gases within the furnace. Top Coat M also has low gas permeability thereby preventing gases from inside the furnace from passing through the thermal barrier material 53 and has excellent emisivity properties meaning that such coating radiates heat energy back into the furnace thereby further limiting heat transfer into fan 10.

FIGS. 8 and 9 are provided to illustrate an exemplary fan 10 positioned with respect to portions of an exemplary heat treating furnace 12. FIG. 8 shows portions of furnace top wall 59 and furnace sidewall 207. Furnace chamber or interior 63 is defined by top wall 59, side walls 207, 209 and by front, rear and bottom walls (not shown). Top wall 59 includes outer and inner surfaces 211, 213. Opening 61 is provided in furnace top wall 59 for receiving fan 10. Opening 59 is defined by sidewalls 215–221.

FIG. 9 is a side sectional view of top wall 59 and fan 10 inserted into top wall opening 61. As is apparent, back plate 13, side plates 17–23, flange 55 and thermal barrier material 53 in cavity 51 are sized and shaped to conform to opening 61. Sidewalls 17–23 are sized to closely abut opening walls 215–221 to prevent loss of heat energy and gases from furnace interior 63. Fan flange 55 is secured along top wall 59 by suitable fasteners, such as screws (not shown). Fan shaft 65 is sized so that fan element 67, is positioned within furnace interior 63. Rotation of fan element 67 causes an even distribution of temperature and gases within furnace interior 63.

Fan 10 may be mounted to furnace wall surfaces other than top wall 59 shown in FIGS. 8 and 9. For example, a fan 10 could be mounted to side wall 207. While not preferred, fan 10 could be mounted to furnace wall exterior surface 207 with appropriate mounting hardware instead of being inserted into a wall opening, such as opening 61. In such an embodiment, fan shaft 65 would be sized for insertion through wall 207 so that fan element 67 is supported in furnace interior 63.

It is also possible that fan 10 can be mounted along other structure positioned with respect to furnace 12 so that fan 10 is in position to displace gases within the furnace chamber or interior 63. For example, fan 10 could be mounted in what is known to persons of skill in the art as a "burner box." The burner box includes walls defining a burner box chamber and the burner box is attached along a furnace wall, such as wall 207 in FIG. 9. One or more ducts are provided to form a gas passageway between the furnace interior 63 and the burner box chamber. Fan 10 could be positioned in a burner box wall as described above with respect to wall 207. Rotation of the fan element, such as element 67, within the burner box chamber draws gas from furnace interior 63 through the duct or ducts, into the burner box chamber, out through the duct or ducts and back into the furnace interior. While the fan element (such as element 67) is not directly in the furnace chamber or interior (such as interior 63), the movement of element 67 displaces gases within the furnace interior and provides an evenly distributed atmosphere within the furnace. Fan 10 may be mounted in other positions and arrangements to displace high temperature gas, for example, within a chamber formed by a pipe.

EXAMPLE AND DATA

Figure 5:
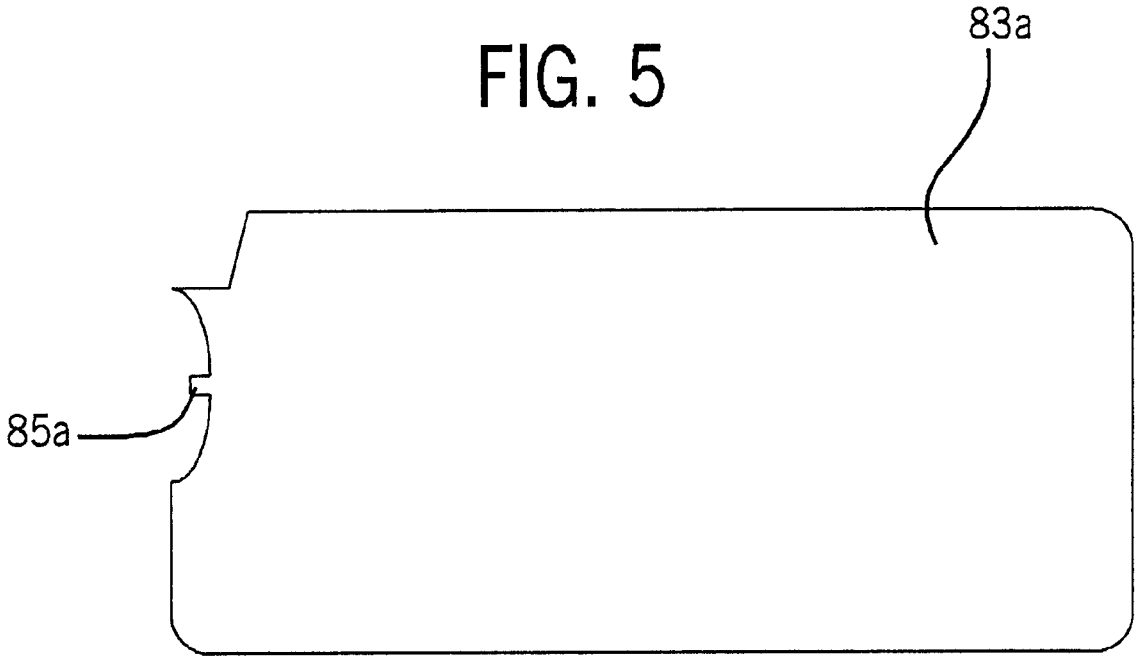
FIG. 5 is a plan view of an exemplary fan blade.
Figure 6:
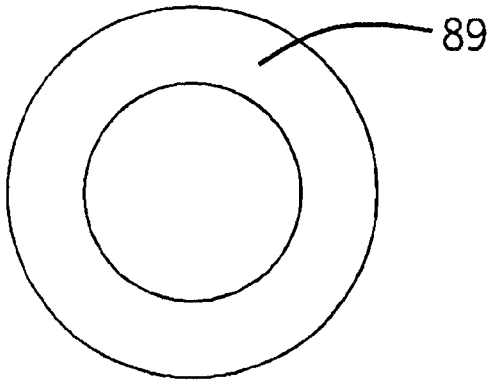
FIG. 6 is a plan view of an exemplary fan blade gusset.

An exemplary fan 10 as shown and described with respect to FIGS. 1–9 was tested to evaluate the efficacy of the fan structure in limiting heat transfer through the fan. Fan frame 11 was constructed of carbon steel plate. The fan shaft 65, blades 83*a–f* and gusset 89 were constructed of #330 stainless steel. Fan shaft 65 had a diameter of 2 inches. Bores 151*a*, 151*b* were provided in shaft as shown in FIG. 5. Thermal barrier material 53, including layer 207, and bearing 109 were provided as described in the example above. A drive motor was provided as shown and described above. The fan was not provided with any active fan-cooling system such as a water or air-cooled system.

The fan was installed through an opening in the furnace wall in a manner shown in FIG. 9. The furnace interior was heated to a temperature of 1310° F. The temperature was held at 1310° F. for 2 hours to allow equilibrium. The fan was operated for the full two hours at a speed of approximately 1800 rpm. Ambient temperature outside the furnace was about 85° F. After two hours, temperature readings were taken at positions along the fan as indicated in Table 1. The temperature readings were taken using a Raytek infrared temperature meter. The results were as follows:

TABLE 1

| Temperature (° F.) | Location of Temperature Measurement | Reference No. |
|---|---|---|
| ≈85 | Ambient air | ** |
| 1310 | Furnace interior | 63 |
| 125 | Fan shaft (between furnace wall and first bearing 109) | 65 |
| 172 | First bearing | 109 |
| 185 | Second bearing | 111 |
| 180 | Pulley | 171 |
| 150–220 | motor (various locations) | 159 |

The data show that the fan structure was highly effective in limiting heat transfer from the furnace and into the fan. The fan shaft and bearing temperatures were significantly below that of the furnace interior and only slightly above the ambient temperature. The bearing and motor temperatures were well within the range required for normal operation and would be expected to have an extended service life.

While not wishing to be bound by any particular theory, it is believed that thermodynamic heat transfer through fan 10, fan shaft 65 and into bearings 109, 111 is significantly limited, particularly by the combination of the thermal barrier material 53 in combination with the bore structure 151*a*, 151*b*. Limitation of heat transfer into bearings 109, 111 and other components (such as motor 159) prevents premature failure of such components thereby extending the operational life of fan 10. Heat transfer through fan 10 is further advantageously limited by the specially configured bearing 109 and shaft arrangement described above. Such result is achieved without the need for any active cooling apparatus such as a water-cooled or compressed-air-cooled system. The fan relies upon a passive air-cooling mechanism in which heat is discharged into the ambient air.

More specifically, it is known that heat transfer in a conductor, such as fan shaft 65, is a function of surface area. Conductive heat transfer is most pronounced along fan shaft core 157. By cross drilling fan shaft 65 (as shown in FIG. 4B) the surface area of shaft 65 is reduced. Further, by positioning bores 151*a*, 151*b* in shaft 65 as shown in FIG. 4B, a portion of core 157 is removed thereby providing a barrier to heat transfer through core 157 and into bearings 109, 111. Additionally, movement of air through bores 151*a*, 151*b* serves to remove heat from shaft 65 as the fan shaft is rotated by motor 159 during operation.

The thermal barrier material 53 (including layer 205 if used) acts as a barrier, particularly to radiant and convective heat transfer from the furnace through fan 10. Thermal barrier material 53 with its shaft-abutting surfaces 203 limits convective heat transfer along fan shaft 65 and through fan 10 to bearings 109, 111. Thermal barrier material 53 reflects radiant heat back into furnace interior 63. Moreover, thermal barrier material 53 further serves as a heat sink drawing heat from fan shaft 65 because of the difference in temperature between the thermally conductive fan shaft 65 and adjacent thermal barrier material 53. Heat energy is discharged from the thermal barrier material to the ambient air.

Conductive heat transfer of remaining heat energy from fan shaft 65 into bearing 109 may be further limited and minimized because of the less than complete surface to surface contact between fan shaft outer surface 73 and inner race 137 due to the slightly oversized nature of inner race 137 with respect to fan shaft 65. Again, heat energy is discharged from the shaft to the ambient air rather than to the bearings and other fan components.

While the principles of this invention have been described in connection with specific embodiments, it should be understood clearly that these descriptions are made only by way of example and are not intended to limit the scope of the invention.

What is claimed:

1. High-temperature fan apparatus for circulating high temperature gas within a chamber defined by wall structure, the fan apparatus configured to limit heat transfer through the fan apparatus without the need for separate fan-cooling apparatus comprising:

a frame having support surfaces configured to support the fan apparatus at an opening in the wall structure;

a fan shaft rotatably secured with respect to the frame by at least one bearing member at a position outside the chamber, the shaft having first and second ends and a shaft outer surface therebetween, the shaft being sized to support a fan element through the wall opening and within the chamber, the shaft further including at least one bore positioned trans-axially through at least a portion of the shaft at a position between the chamber and the at least one bearing member to limit heat transfer across the bore;

at least one fan element secured along the shaft first end; and thermal barrier material secured with respect to the frame, the thermal barrier material having portions positioned about the shaft and shaft-contact surfaces in direct contact with the shaft to limit heat transfer through the frame and along the shaft outer surface.

2. The high-temperature fan apparatus of claim 1 wherein the frame is positioned at least partially in the wall opening and the frame and thermal barrier material are conformably shaped to said opening.

3. The high-temperature fan apparatus of claim 2 wherein the frame comprises:

a substantially flat back plate;

at least one sidewall secured to and projecting outwardly from the back plate, the at least one sidewall being conformably shaped to the wall opening and sized for insertion into the wall opening; and the at least one sidewall and back plate form a cavity in which the thermal barrier material is positioned.

4. The high-temperature fan apparatus of claim 1 further including a motor coupled in torque-transmitting relationship to the shaft at a shaft position between the bore, to and including the shaft second end.

5. The high-temperature fan apparatus of claim 4 wherein:

the apparatus further includes a motor mount secured with respect to the frame;

the motor is secured to the motor mount; and the motor is coupled to the shaft by horsepower-transmitting members.

6. The high-temperature fan apparatus of claim 5 wherein the horsepower-transmitting members comprise:

a first pulley secured for co-rotation with a motor shaft;

a second pulley secured for co-rotation with the fan shaft; and a belt linking the pulleys.

7. The high-temperature fan apparatus of claim 1 wherein the apparatus further includes:

a bearing mount secured with respect to the frame;

first and second axially-aligned bearings secured to the bearing mount; and the fan shaft is journaled in the bearings.

8. The high-temperature fan apparatus of claim 7 wherein:

the first bearing comprises:

an inner race, an outer race and ball bearings positioned therebetween, the inner race having an inner surface facing the fan shaft and an inside diameter; and a pin projecting radially inwardly from the inner race; and the fan shaft further includes:

an opening in the shaft outer surface keyed to the pin for co-rotation of the shaft and inner race; and the shaft is sized so that the shaft has a diameter which is less than the inner race inside diameter;

whereby the shaft outside surface and inner race inner surface contact along less than all of the respective surfaces when the shaft is journaled in the first bearing.

9. The high-temperature fan apparatus of claim 1 wherein the at least one bore is positioned trans-axially entirely through the shaft.

10. The high-temperature fan apparatus of claim 9 wherein the shaft includes first and second co-planar bores, each bore positioned along an axis transverse to the other and normal to the shaft.

11. The high-temperature fan apparatus of claim 1 wherein the fan element comprises plural fan blades secured at one end along the fan shaft and extending radially outwardly from said shaft.

12. The high-temperature fan apparatus of claim 1 wherein the thermal barrier material comprises plural insulation elements, each element having side walls, end walls an inner edge surface positioned to face the chamber and an opposed outer edge surface, the elements being arranged one after the other so that adjacent sidewalls abut and the shaft-contact surfaces comprise predetermined portions of the insulation elements.

13. The high-temperature fan apparatus of claim 12 wherein the thermal barrier material further includes heat-resistant barrier material along the insulation element inner edge surfaces.

14. High-temperature fan apparatus for displacing high-temperature gas within a chamber defined by a least one wall, the fan apparatus configured to limit heat transfer through the fan apparatus without the need for an active fan-cooling apparatus comprising:

a frame having support surfaces configured to support the fan apparatus with respect to the chamber;

a fan shaft rotatably secured with respect to the frame by at least one bearing member at a position outside the chamber, the shaft having first and second ends and a shaft outer surface therebetween, the shaft being sized to support a fan element in position to displace gas within the chamber, the shaft further including at least one bore positioned trans-axially through at least a portion of the shaft at a position between the fan shaft first end and the at least one bearing member and outside of the chamber to limit heat transfer across the bore;

at least one fan element secured along the shaft in position to displace gas within the chamber; and thermal barrier material secured with respect to the frame, the thermal barrier material having portions positioned about the shaft and shaft-contact surfaces in direct contact with the shaft to limit heat transfer through the frame and along the shaft outer surface.

15. The high-temperature fan apparatus of claim 14 wherein the frame comprises:

a substantially flat back plate;

at least one sidewall secured to and projecting outwardly from the back plate, the at least one sidewall being conformably shaped to an opening in the chamber-defining wall and sized for insertion into the opening; and the at least one sidewall and back plate form a cavity in which the thermal barrier material is positioned.

16. The high-temperature fan apparatus of claim 14 wherein:

the apparatus further includes a motor mount secured with respect to the frame;

a motor is secured to the motor mount; and the motor is coupled to the shaft by horsepower-transmitting members.

17. The high-temperature fan apparatus of claim 16 wherein the horsepower-transmitting members comprise:

a first pulley secured for co-rotation with a motor shaft;

a second pulley secured for co-rotation with the fan shaft; and a belt linking the pulleys.

18. The high-temperature fan apparatus of claim 14 wherein the apparatus further includes:

a bearing mount secured with respect to the frame;

first and second axially-aligned bearings secured to the bearing mount; and the fan shaft is journaled in the bearings.

19. The high-temperature fan apparatus of claim 18 wherein:

the first bearing comprises:

an inner race, an outer race and ball bearings positioned therebetween, the inner race having an inner surface facing the fan shaft and an inside diameter; and a pin projecting radially inwardly from the inner race; and the fan shaft further includes:

an opening in the shaft outer surface keyed to the pin for co-rotation of the shaft and inner race; and the shaft is sized so that the shaft has a diameter which is less than the inner race inside diameter;

whereby the shaft outside surface and inner race inner surface contact along less than all of the respective surfaces when the shaft is journaled in the first bearing.

20. The high-temperature fan apparatus of claim 14 wherein the at least one bore is positioned trans-axially entirely through the shaft.

21. The high-temperature fan apparatus of claim 20 wherein the shaft includes first and second co-planar bores, each bore positioned along an axis transverse to the other and normal to the shaft.

22. The high-temperature fan apparatus of claim 14 wherein the fan element comprises plural fan blades secured at one end along the fan shaft and extending radially outwardly from said shaft.

23. The high-temperature fan apparatus of claim 14 wherein the thermal barrier material comprises plural insulation elements, each element having side walls, end walls an inner edge surface and an opposed outer edge surface, the elements being arranged one after the other so that adjacent sidewalls abut and the shaft-contact surfaces comprise predetermined portions of the insulation elements.

24. The high-temperature fan apparatus of claim 23 wherein the thermal barrier material further includes heat-resistant barrier material along the insulation element inner edge surfaces.

25. High-temperature fan apparatus for circulating high temperature gas within a chamber defined by wall structure, the fan apparatus configured to limit heat transfer through the fan apparatus without the need for separate fan-cooling apparatus comprising:

a frame having support surfaces configured to support the fan apparatus at an opening in the wall structure;

a fan shaft rotatably secured with respect to the frame by at least one bearing member at a position outside the chamber, the shaft having first and second ends and a shaft outer surface therebetween, the shaft being sized to support a fan element through the wall opening and within the chamber, the shaft further including at least one bore positioned trans-axially through at least a portion of the shaft at a position between the chamber and the at the least one bearing member to limit heat transfer across the bore;

at least one fan element secured along the shaft first end; and thermal barrier material secured with respect to the frame, the thermal barrier material having portions positioned about the shaft [and shaft-contact surfaces in direct contact with the shaft] to limit heat transfer through the frame and along the shaft outer surface.

26. The high-temperature fan apparatus of claim 25 further including a motor coupled in torque-transmitting relationship to the shaft at a shaft position between the bore, to and including the shaft second end.

27. The high-temperature fan apparatus of claim 25 wherein the at least one bore is positioned trans-axially entirely through the shaft.

28. The high-temperature fan apparatus of claim 25 wherein the shaft includes first and second co-planar bores, each bore positioned along an axis transverse to the other and normal to the shaft.

29. The high-temperature fan apparatus of claim 25 wherein the fan element comprises plural fan blades secured at one end along the fan shaft and extending radially outwardly from said shaft.

30. The high-temperature fan apparatus of claim 25 wherein the thermal barrier material further includes at least one shaft-contact surface in direct contact with the shaft.

31. The high-temperature fan apparatus of claim 30 wherein the thermal barrier material comprises plural insulation elements, each element having side walls, end walls an inner edge surface positioned to face the chamber and an opposed outer edge surface, the elements being arranged one after the other so that adjacent sidewalls abut and the at least one shaft-contact surface comprises predetermined portions of the insulation elements.

* * * * *

UNITED STATES PATENT AND TRADEMARK OFFICE

CERTIFICATE OF CORRECTION

PATENT NO. : 6,454,530 B1
DATED : September 24, 2002
INVENTOR(S) : Lange

It is certified that error appears in the above-identified patent and that said Letters Patent is hereby corrected as shown below:

Column 6,
Line 46, after "compression" delete "sell", insert -- seal --.

Column 15,
Lines 23-24, after "shaft" delete "[shaft-contact surfaces in direct contact with the shaft]"

Signed and Sealed this

Tenth Day of February, 2004

JON W. DUDAS
*Acting Director of the United States Patent and Trademark Office*